US011193180B2

(12) United States Patent
Takashima et al.

(10) Patent No.: US 11,193,180 B2
(45) **Date of Patent: *Dec. 7, 2021**

(54) HIGH-STRENGTH STEEL SHEET AND METHOD FOR MANUFACTURING THE SAME

(71) Applicant: JFE Steel Corporation, Tokyo (JP)

(72) Inventors: Katsutoshi Takashima, Tokyo (JP); Yoshimasa Funakawa, Tokyo (JP); Takashi Kobayashi, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 541 days.

This patent is subject to a terminal disclaimer.

(21) Appl. No.: 16/092,323

(22) PCT Filed: Mar. 22, 2017

(86) PCT No.: PCT/JP2017/011288

§ 371 (c)(1),
(2) Date: Oct. 9, 2018

(87) PCT Pub. No.: WO2017/179372

PCT Pub. Date: Oct. 19, 2017

(65) Prior Publication Data

US 2021/0207234 A1 Jul. 8, 2021

(30) Foreign Application Priority Data

Apr. 14, 2016 (JP) ..... JP2016-080947

(51) Int. Cl.

| | |
|---|---|
| ***C21D 9/46*** | (2006.01) |
| ***C21D 6/00*** | (2006.01) |
| ***C21D 8/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |

(Continued)

(52) U.S. Cl.

CPC ..... *C21D 9/46* (2013.01); *C21D 6/004* (2013.01); *C21D 6/005* (2013.01); *C21D 6/008* (2013.01); *C21D 8/0205* (2013.01); *C21D 8/0226* (2013.01); *C21D 8/0236* (2013.01); *C21D 8/0263* (2013.01); *C22C 38/001* (2013.01); *C22C 38/002* (2013.01); *C22C 38/005* (2013.01); *C22C 38/008* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C22C 38/52* (2013.01); *C22C 38/54* (2013.01)

(58) Field of Classification Search

CPC ..... C21D 9/46; C21D 6/004; C21D 6/005; C21D 6/008; C21D 8/0205; C21D 8/0226; C21D 8/0236; C21D 8/0263; C22C 38/001; C22C 38/002; C22C 38/005; C22C 38/008; C22C 38/02; C22C 38/04; C22C 38/06; C22C 38/42; C22C 38/44; C22C 38/46; C22C 38/48; C22C 38/50; C22C 38/52; C22C 38/54

See application file for complete search history.

(56) References Cited

U.S. PATENT DOCUMENTS

| | | | |
|---|---|---|---|
| 6,423,426 | B1 | 7/2002 | Kobayashi et al. |
| 10,077,486 | B2 | 9/2018 | Takashima et al. |
| 2010/0218857 | A1 | 9/2010 | Nakagaito et al. |

(Continued)

FOREIGN PATENT DOCUMENTS

| | | | |
|---|---|---|---|
| CN | 102712980 | A | 10/2012 |
| CN | 105452513 | A | 3/2016 |

(Continued)

OTHER PUBLICATIONS

International Search Report and Written Opinion for International Application No. PCT/JP2017/011288, dated Jun. 13, 2017, 5 pages.

(Continued)

*Primary Examiner* — Christopher S Kessler

*Assistant Examiner* — Andrew M Cheung

(74) *Attorney, Agent, or Firm* — RatnerPrestia

(57) ABSTRACT

A high-strength steel sheet having a chemical composition containing, by mass %, C: 0.15% to 0.25%, Si: 1.00% to 2.20%, Mn: 2.00% to 3.50%, P: 0.05% or less, S: 0.005% or less, Al: 0.01% to 0.50%, N: 0.010% or less, B: 0.0003% to 0.0050%, one, two, or more selected from Ti: 0.005% to 0.05%, Cu: 0.003% to 0.50%, Ni: 0.003% to 0.50%, Sn: 0.003% to 0.50%, Co: 0.003% to 0.05%, and Mo: 0.003% to 0.50%, and the balance being Fe and inevitable impurities and a microstructure including, in terms of volume fraction, 15% or less (including 0%) of ferrite, 2% to 15% of retained austenite, 10% or less (including 0%) of martensite, and the balance being bainite and tempered martensite, in which the average number of cementite grains having a grain diameter of 0.04 μm or more existing in the bainite and tempered martensite grains is 10 or more.

4 Claims, No Drawings

(51) Int. Cl.
*C22C 38/52* (2006.01)
*C22C 38/54* (2006.01)

(56) References Cited

U.S. PATENT DOCUMENTS

| | | | | |
|---|---|---|---|---|
| 2013/0133792 | A1 | 5/2013 | Nakagaito et al. | |
| 2014/0242415 | A1 | 8/2014 | Azuma et al. | |
| 2014/0377584 | A1* | 12/2014 | Hasegawa | C22C 38/001 428/659 |
| 2016/0208359 | A1 | 7/2016 | Kasuya et al. | |
| 2017/0107591 | A1 | 4/2017 | Takashima et al. | |
| 2018/0195143 | A1 | 7/2018 | Shimori et al. | |

FOREIGN PATENT DOCUMENTS

| | | | |
|---|---|---|---|
| CN | 105492643 | A | 4/2016 |
| EP | 2530179 | A | 5/2012 |
| EP | 3009527 | A1 | 4/2016 |
| EP | 3012339 | A1 | 4/2016 |
| EP | 3101147 | A1 | 12/2016 |
| JP | 4091894 | B2 | 5/2008 |
| JP | 4411221 | B2 | 2/2010 |
| JP | 2011144404 | A | 7/2011 |
| JP | 2012031462 | A | 2/2012 |
| JP | 2016050343 | A | 4/2016 |
| WO | 2013047819 | A1 | 4/2013 |
| WO | 2015019558 | A1 | 2/2015 |
| WO | 2015115059 | A1 | 8/2015 |
| WO | 2015151427 | A1 | 10/2015 |
| WO | 2017038070 | A1 | 3/2017 |

OTHER PUBLICATIONS

Extended European Search Report for European Application No. 17 782 190.7, dated Feb. 12, 2019, 9 pages.
Chinese Office Action with Search Report for Chinese Application No. 201780023592.0, dated Dec. 3, 2019, 9 pages.
Chinese Office Action for Chinese Application No. 201780023592.0, dated May 22, 2020, with Concise Statement of Relevance of Office Action, 10 pages.
Korean Office Action for Korean Application No. 10-2018-7029560, dated Dec. 10, 2019, with Concise Statement of Relevance of Office Action, 6 pages.
Ex Parte Quayle Office Action for U.S. Appl. No. 15/115,138, mailed Jul. 6, 2018, 7 pages.
Final Office Action for U.S. Appl. No. 15/535,175, dated Aug. 30, 2019, 10 pages.
Non Final Office Action for U.S. Appl. No. 14/349,503, dated Jun. 12, 2015, 8 pages.
Non Final Office Action for U.S. Appl. No. 14/911,059, dated Jan. 17, 2018, 13 pages.
Non Final Office Action for U.S. Appl. No. 15/535,175, dated Apr. 24, 2019, 16 pages.
Non-Final Office Action for U.S. Appl. No. 16/071,581, dated Aug. 21, 2020, 12 pages.

* cited by examiner

HIGH-STRENGTH STEEL SHEET AND METHOD FOR MANUFACTURING THE SAME

CROSS REFERENCE TO RELATED APPLICATIONS

This is the U.S. National Phase application of PCT/JP2017/011288, filed Mar. 22, 2017, which claims priority to Japanese Patent Application No. 2016-080947, filed Apr. 14, 2016, the disclosures of these applications being incorporated herein by reference in their entireties for all purposes.

FIELD OF THE INVENTION

The present invention relates to a high-strength steel sheet and a method for manufacturing the steel sheet, and in particular, to a high-strength steel sheet which can preferably be used for structural parts of, for example, an automobile.

BACKGROUND OF THE INVENTION

Nowadays, since $CO_2$ emission regulations are being tightened due to increasing concerns about environmental problems, weight reduction of an automobile body to improve fuel efficiency is an issue to be addressed in the automobile world. Therefore, since there is a growing trend toward thinner wall of automobile parts using a high-strength steel sheet, there is a growing trend toward using a steel sheet having a tensile strength (TS) of 1180 MPa or more. However, a high-strength steel sheet which is used for the structural members and reinforcing members of an automobile is required to have excellent formability. In particular, when parts having a complex shape are formed, such a steel sheet is required to be excellent not in terms of a single property such as elongation, hole expansion formability, or bending workability, but in terms of all such properties. Moreover, in the case of a steel sheet having a tensile strength (TS) of 1180 MPa or more, there may be a problem in that delayed fracture (hydrogen embrittlement) occurs due to hydrogen entering from a usage environment. Therefore, when a high-strength steel sheet is used, the steel sheet is required to be excellent in terms of press formability and delayed fracture resistance.

Conventionally, examples of a high-strength thin steel sheet having both satisfactory formability and high strength include a TRIP steel sheet. Since this TRIP steel sheet has a steel sheet microstructure including retained austenite, in the case where the steel sheet is deformed by performing processing at a temperature equal to or higher than the martensite transformation start temperature, it is possible to achieve high elongation due to retained austenite transforming into martensite through transformation induced by stress or strain. However, there is a disadvantage in that this TRIP steel sheet is poor in terms of hole expansion formability, because retained austenite transforms into martensite to generate a crack at the interface with ferrite when punching is performed. Therefore, Patent Literature 1 discloses a TRIP steel sheet having an increased elongation and stretch flange formability as a result of forming a microstructure including at least 60% of bainitic ferrite and 20% or less of polygonal ferrite. In addition, Patent Literature 2 discloses a TRIP steel sheet excellent in terms of hole expansion formability and ductility obtained by controlling the area fractions of bainite and retained austenite.

PATENT LITERATURE

PTL 1: Japanese Patent No. 4411221
PTL 2: Japanese Patent No. 4091894

SUMMARY OF THE INVENTION

However, in the case of Patent Literature 1, elongation, hole expansion formability, and bending workability are not increased in a high-strength range represented by a TS of 1180 MPa or more, and no consideration is given to a risk of delayed fracture. In addition, in the case of Patent Literature 2, since elongation is too low in relation to strength, it is difficult to say that sufficient formability is achieved.

As described above, it is difficult to achieve not only elongation, hole expansion formability, and bending workability, which ensure excellent press formability, but also excellent delayed fracture resistance in the case of a high-strength steel sheet having a TS of 1180 MPa or more, and it is a fact that a steel sheet excellent in terms of all such properties (strength, elongation, hole expansion formability, bending workability, and delayed fracture resistance) has not yet been developed, even in the case of other kinds of steel sheets.

An object according to aspects of the present invention is, by solving the problems of the related art described above, to provide a high-strength steel sheet excellent in terms of elongation, hole expansion formability, bending workability, and delayed fracture resistance and a method for manufacturing the steel sheet.

The present inventors diligently conducted investigations and, as a result, found that, by controlling the volume fractions of ferrite, retained austenite, martensite, bainite, and tempered martensite in a steel sheet microstructure so that these fractions take specific values, by decreasing the average crystal grain diameters of such phases, and forming fine carbides in a steel sheet microstructure in order to increase elongation, hole expansion formability, bending workability, and delayed fracture resistance in the case of a high-strength steel sheet having a TS of 1180 MPa or more, it is possible to achieve high ductility, high hole expansion formability, high bending workability, and high delayed fracture resistance. Aspects of the present invention are based on the findings described above.

Delayed fracture is a phenomenon in which fracture occurs as a result of a crack forming and growing due to hydrogen entering a steel sheet. Here, martensite in a steel sheet microstructure, in particular, martensite which has not been tempered, promotes the growth of a crack in delayed fracture. Therefore, it is possible to inhibit the growth of a crack by tempering martensite in a steel sheet microstructure. However, in the case of a thin steel sheet for an automobile, there is a risk in that delayed fracture occurs due to hydrogen entering the steel sheet as a result of the steel sheet being exposed to a usage environment when the steel sheet is mounted on an actual automobile after having been subjected to press forming. That is, a TRIP steel sheet including retained austenite is exposed to a usage environment after retained austenite, which contributes to an increase in elongation, has transformed into martensite. Therefore, it is necessary that consideration be given to a steel sheet microstructure after press forming has been performed in order to increase delayed fracture resistance.

In addition, regarding hole expansion formability, in the case where martensite, retained austenite, cementite, and so forth, which are harder than ferrite, exist in a steel sheet microstructure, a crack is generated as a result of voids being generated at the interfaces of such phases, in particular, the interfaces with soft ferrite when punching is performed, and being combined with each other to grow in a subsequent hole expansion process. On the other hand, there is an increase in elongation as a result of soft ferrite and retained austenite existing in a steel sheet microstructure. Regarding bending workability, the homogeneity of a steel sheet microstructure is important, and, in the case where a large amount of soft ferrite exists, local strain concentration occurs at the interface with a hard phase, which results in a crack being generated at the interface.

Therefore, the present inventors diligently conducted investigations and, as a result, found that not only satisfactory strength, but also satisfactory elongation, delayed fracture resistance, and hole expansion formability are achieved by achieving satisfactory strength and hole expansion formability, even in the case where some amount of soft ferrite is included, as a result of controlling the volume fractions of a soft phase (ferrite), and hard phases (martensite and retained austenite), which become starting points at which voids are generated, as a result of forming hard intermediate phases (being intermediate in hardness between ferrite, which is a soft phase, and martensite, which is a hard phase) such as tempered martensite and bainite, and as a result of decreasing the crystal grain diameter and by forming hydrogen trap sites as a result of cementite being included in a steel sheet microstructure. Moreover, it was also found that there is an improvement in delayed fracture resistance by inhibiting a hydrogen evolution reaction as a result of increasing the hydrogen overpotential of a steel sheet through the addition of chemical elements having nobler standard electrode potentials than Fe. To achieve this improvement, after having dispersed fine cementite grains in the microstructure of a hot-rolled steel sheet, by coarsening such cementite grains when subsequent continuous annealing (second heat treatment) is performed, hydrogen trap sites are formed. Although coarse cementite has little effect on strength, such cementite inhibits the generation of voids during hole expansion. It was found that the steel sheet microstructure according to aspects of the present invention is formed through bainite transformation when cooling is performed for continuous annealing (second heat treatment) and through a heat treatment for forming retained austenite, and for forming bainite and tempered martensite in a process for tempering martensite, which has been formed when the cooling is performed, when soaking following the cooling is performed.

As described above, in accordance with aspects of the present invention, chemical elements which are effective for increasing hydrogen overpotential, that is, Ti, Cu, Ni, Sn, Co, and Mo, are added, and a heat treatment is performed under appropriate hot rolling and annealing conditions. That is, it is possible to increase elongation, hole expansion formability, bending workability, and delayed fracture resistance by decreasing the crystal grain diameter of ferrite, retained austenite, martensite, bainite, and tempered martensite, by ensuring the volume fraction of retained austenite to be sufficiently large to achieve satisfactory elongation, and by controlling the volume fractions of ferrite, bainite, tempered martensite, and martensite to be within ranges in which strength and ductility are not impaired. Here, although Ti has a lower standard electrode potential than that of Fe, since Ti is effective for increasing hydrogen overpotential, and since Ti forms precipitates in the form of TiC, which is a hydrogen trap site, Ti is effective for increasing delayed fracture resistance.

That is, aspects of the present invention are embodied by items [1] to [3] below.

[1] A high-strength steel sheet having a chemical composition containing, by mass %, C: 0.15% to 0.25%, Si: 1.00% to 2.20%, Mn: 2.00% to 3.50%, P: 0.05% or less, S: 0.005% or less, Al: 0.01% to 0.50%, N: 0.010% or less, B: 0.0003% to 0.0050%, one, two, or more selected from Ti: 0.005% to 0.05%, Cu: 0.003% to 0.50%, Ni: 0.003% to 0.50%, Sn: 0.003% to 0.50%, Co: 0.003% to 0.05%, and Mo: 0.003% to 0.50%, and the balance being Fe and inevitable impurities and a microstructure including, in terms of volume fraction, 15% or less (including 0%) of ferrite having an average crystal grain diameter of 2 μm or less, 2% to 15% of retained austenite having an average crystal grain diameter of 2 μm or less, 10% or less (including 0%) of martensite having an average crystal grain diameter of 3 μm or less, and the balance being bainite and tempered martensite having an average crystal grain diameter of 6 μm or less, in which the average number of cementite grains having a grain diameter of 0.04 μm or more existing in the bainite and tempered martensite grains is 10 or more.

[2] The high-strength steel sheet according to item [1], in which the chemical composition further contains, by mass %, one, two, or more selected from V: 0.05% or less, Nb: 0.05% or less, Cr: 0.50% or less, and Ca and/or REM: 0.0050% or less in total.

[3] A method for manufacturing a high-strength steel sheet, the method including performing hot rolling on a steel slab having the chemical composition according to item [1] or [2] with a finish rolling completing temperature of 850° C. to 950° C., performing primary cooling to a temperature of 650° C. or lower at a first average cooling rate of 80° C./s or more, performing secondary cooling to a temperature of 550° C. or lower at a second average cooling rate of 5° C./s or more, coiling the cooled steel sheet at a coiling temperature of 550° C. or lower, pickling the obtained hot-rolled steel sheet, performing a heat treatment in which the pickled steel sheet is heated to a temperature range of 400° C. to 700° C., subsequently performing cold rolling, heating the cold-rolled steel sheet to a temperature range of 800° C. to 930° C. at an average heating rate of 3° C./s to 30° C./s, holding the heated steel sheet at a first soaking temperature in a temperature range of 800° C. to 930° C. for 30 seconds or more, cooling the held steel sheet from the first soaking temperature to a cooling stop temperature of 70° C. to 250° C. at a third average cooling rate of 3° C./s or more, heating the cooled steel sheet to a temperature of 320° C. to 470° C., holding the heated steel sheet at a second soaking temperature in a temperature range of 320° C. to 470° C. for 30 seconds or more, cooling the held steel sheet to room temperature, and pickling the cooled steel sheet.

The steel sheet according to aspects of the present invention has not only very high tensile strength (a TS of 1180 MPa or more), but also high elongation and hole expansion formability accompanied by excellent bending workability. In addition, since delayed fracture due to hydrogen entering a member, which has been manufactured from the steel sheet through forming processing, is less likely to occur, the steel sheet has excellent delayed fracture resistance. It is possible to stably obtain a high-strength steel sheet excellent in terms of strength, elongation, hole expansion formability, bending workability, and delayed fracture resistance characterized by, for example, a tensile strength of 1180 MPa or more, a total elongation of 17.0% or more, a hole expansion ratio of 45% or more, bending workability represented by an R/t (where R is the tip radius of a V-block, and t is the thickness) of 2.0 or less, and the fact that fracture does not occur when the steel sheet is immersed for 100 hours in a hydrochloride solution having a temperature of 20° C. and a pH of 1.5.

DETAILED DESCRIPTION OF EMBODIMENTS OF THE INVENTION

Hereafter, embodiments of the present invention will be specifically described. Hereinafter, "%" used when describing constituent chemical elements denotes "mass %".

C: 0.15% to 0.25%

C is a chemical element which is effective for increasing the strength of a steel sheet, which contributes to the formation of second phases, that is, bainite, tempered martensite, retained austenite, and martensite in accordance with aspects of the present invention, and which increases the hardness of martensite and tempered martensite. In the case where the C content is less than 0.15%, it is difficult to achieve the necessary volume fractions of bainite, tempered martensite, retained austenite, and martensite. In addition, in the case where the C content is less than 0.15%, since there is an increase in the volume fraction of ferrite, it is difficult to achieve a TS of 1180 MPa or more. Therefore, the C content is set to be 0.15% or more, or preferably 0.17% or more. On the other hand, in the case where the C content is excessively large, since there is an increase in the difference in hardness among ferrite, tempered martensite, and martensite, there is a decrease in hole expansion formability. Therefore, the C content is set to be 0.25% or less, or preferably 0.23% or less.

Si: 1.00% to 2.20%

Since Si increases the strength of ferrite through solid solution strengthening, there is a decrease in the difference in hardness from hard phases, which results in an increase in hole expansion ratio. It is necessary that the Si content be 1.00% or more, or preferably 1.20% or more, in order to realize such an effect. However, in the case where the Si content is excessively large, there is a decrease in phosphatability. Therefore, the Si content is set to be 2.20% or less, or preferably 2.00% or less.

Mn: 2.00% to 3.50%

Mn is a chemical element which contributes to an increase in strength through solid solution strengthening and through the formation of hard phases (retained austenite and martensite) and hard intermediate phases (bainite and tempered martensite). In addition, Mn is a chemical element which stabilizes austenite and which is necessary for controlling the volume fractions of hard phases and hard intermediate phases. It is necessary that the Mn content be 2.00% or more in order to realize such effects. On the other hand, in the case where the Mn content is excessively large, since there is an excessive increase in the volume fraction of martensite, and since there is an increase in the hardness of martensite and tempered martensite, there is a decrease in hole expansion formability. In addition, in the case where hydrogen enters a steel sheet, since there is an increase in sliding constraint at grain boundaries, a crack tends to grow at crystal grain boundaries, which results in a decrease in delayed fracture resistance. Therefore, the Mn content is set to be 3.50% or less, or preferably 3.00% or less.

P: 0.05% or less

P contributes to an increase in strength through solid solution strengthening. However, in the case where the P content is excessively large, grain boundary embrittlement occurs due to significant segregation at grain boundaries, and there is a deterioration in weldability. Therefore, the P content is set to be 0.05% or less, or preferably 0.04% or less. Although there is no particular limitation on the lower limit of the P content, there is an increase in steel-making costs in the case where an attempt is made to realize an ultralow P content. Therefore, it is preferable that the P content be 0.0005% or more.

S: 0.005% or less

In the case where the S content is large, a large amount of sulfides such as MnS is formed, and MnS becomes a starting point at which a crack is generated when hydrogen enters a steel sheet, which results in a decrease in delayed fracture resistance. Therefore, the upper limit of Mn content is set to be 0.005% or less, or preferably 0.0045% or less. Although there is no particular limitation on the lower limit of the S content, there is an increase in steel-making costs in the case where an attempt is made to realize an ultralow S content. Therefore, it is preferable that the S content be 0.0005% or more.

Al: 0.01% to 0.50%

Al is a chemical element which is necessary for deoxidation, and it is necessary that the Al content be 0.01% or more in order to realize such an effect. On the other hand, although Al contributes to the formation of retained austenite as a result of being effective for inhibiting the precipitation of cementite when bainite transformation occurs, Al inhibits an increase in the grain diameter of cementite, which is a hydrogen trap site. Therefore, the upper limit of the Al content is set to be 0.50%, or preferably 0.45% or less.

N: 0.010% or less

Since N deteriorates bending workability and hole expansion formability as a result of forming nitrides having a large grain diameter, it is necessary that the N content be decreased. In the case where the N content is more than 0.010%, such a tendency becomes marked. Therefore, the N content is set to be 0.010% or less, or preferably 0.0050% or less.

B: 0.0003% to 0.0050%

B is a chemical element which contributes to an increase in strength by increasing hardenability and by forming hard phases and hard intermediate phases and which do not decrease the martensite transformation start temperature while maintaining hardenability. Moreover, B is effective for inhibiting the formation of ferrite and pearlite when cooling following finish rolling is performed in a hot rolling process. It is necessary that the B content be 0.0003% or more in order to realize such effects. On the other hand, in the case where the B content is more than 0.0050%, such effects become saturated. Therefore, the B content is set to be 0.0050% or less, or preferably 0.0040% or less.

In accordance with aspects of the present invention, one, two, or more of the following constituent chemical elements are added in addition to the constituent chemical elements described above.

Ti: 0.005% to 0.05%

Ti is a chemical element which can contribute to an increase in strength by forming fine carbonitrides. Moreover, Ti plays a role in preventing B, which is a chemical element necessary for aspects of the present invention, from reacting with N. In addition, since fine carbonitrides of Ti become hydrogen trap sites and increase hydrogen overpotential, there is an increase in delayed fracture resistance. It is necessary that the lower limit of the Ti content be 0.005% or more, or preferably 0.008% or more, in order to realize such effects. On the other hand, in the case where the Ti content is large, there is a significant decrease in elongation. Therefore, the Ti content is set to be 0.05% or less, or preferably 0.035% or less.

Cu: 0.003% to 0.50%

Since Cu has a nobler standard electrode potential than that of Fe, in the case where Cu is added, hydrogen evolution is inhibited due to an increase in hydrogen overpotential, that is, there is a decrease in the amount of hydrogen entering a steel sheet. As a result, there is an increase in delayed fracture resistance. In addition, Cu is a chemical element which contributes to an increase in strength through solid solution strengthening. It is necessary that the Cu content be 0.003% or more, or preferably 0.010% or more in order to realize such effects. On the other hand, in the case where the Cu content is more than 0.50%, such effects become saturated, and surface defects caused by Cu tend to occur. Therefore, the Cu content is set to be 0.50% or less, or preferably 0.30% or less.

Ni: 0.003% to 0.50%

Ni is, like Cu, a chemical element which increases delayed fracture resistance by increasing hydrogen overpotential, and it is necessary that the Ni content be 0.003% or more, or preferably 0.01% or more in order to realize such an effect. In addition, in the case where Ni is added along with Cu, Ni is effective for inhibiting surface defects caused by Cu from occurring. Therefore, Ni is effective when Cu is added. On the other hand, in the case where the Ni content is more than 0.50%, such effects become saturated. Therefore, the Ni content is set to be 0.50% or less, or preferably 0.30% or less.

Sn: 0.003% to 0.50%

Sn is, like Cu, a chemical element which increases delayed fracture resistance by increasing hydrogen overpotential, and it is necessary that the Sn content be 0.003% or more, or preferably 0.007% or more in order to realize such an effect. On the other hand, in the case where the Sn content is more than 0.50%, such an effect becomes saturated, and there is a decrease in ductility. Therefore, the Sn content is set to be 0.50% or less, or preferably 0.40% or less.

Co: 0.003% to 0.05%

Co is, like Cu, a chemical element which increases delayed fracture resistance by increasing hydrogen overpotential, and it is necessary that the Co content be 0.003% or more, or preferably 0.005% or more in order to realize such an effect. On the other hand, in the case where the Co content is more than 0.05%, such an effect becomes saturated. Therefore, the Co content is set to be 0.05% or less, or preferably 0.03% or less.

Mo: 0.003% to 0.50%

Mo is a chemical element which, like Cu, increases delayed fracture resistance by increasing hydrogen overpotential and which contributes to an increase in strength. It is necessary that the Mo content be 0.003% or more, or preferably 0.005% or more in order to realize such effects. On the other hand, in the case where the Mo content is more than 0.50%, such effects become saturated. Therefore, the Mo content is set to be 0.50% or less, or preferably 0.40% or less.

In accordance with aspects of the present invention, one, two, or more of the following constituent chemical elements may be added in addition to the constituent chemical elements described above.

V: 0.05% or less

V can contribute to an increase in strength by forming fine carbonitrides. It is preferable that the V content be 0.01% or more in order to realize such an effect. On the other hand, in the case where the V content is large and more than 0.05%, the effect of increasing strength is small, and there is an increase in alloy costs. Therefore, it is preferable that the V content be 0.05% or less.

Nb: 0.05% or less

Since Nb, like V, can contribute to an increase in strength by forming fine carbonitrides, Nb may be added as needed. It is preferable that the Nb content be 0.005% or more in order to realize such an effect. On the other hand, in the case where the Nb content is large, there is a significant decrease in elongation. Therefore, it is preferable that the Nb content be 0.05% or less.

Cr: 0.50% or less

Since Cr is a chemical element which contributes to an increase in strength, Cr may be added as needed. It is preferable that the Cr content be 0.10% or more in order to realize such an effect. On the other hand, in the case where the Cr content is more than 0.50%, since an excessive amount of martensite is formed, surface defects tend to occur. Therefore, it is preferable that the Cr content be 0.50% or less.

Ca and/or REM: 0.0050% or less in total

Since Ca and REM are chemical elements which decrease the negative effect of sulfides on hole expansion formability through the spheroidizing of sulfides, these chemical elements may be added as needed. It is preferable that the total content of these chemical elements be 0.0005% or more in order to realize such an effect. On the other hand, in the case where the total content of these chemical elements is more than 0.0050%, such an effect becomes saturated. Therefore, the total content of these chemical elements is set to be 0.0050% or less.

The remainder which is other than the constituent chemical elements described above is Fe and inevitable impurities. Examples of inevitable impurities include Sb and Zn, and the acceptable ranges of the Sb content and the Zn content are Sb: 0.01% or less and Zn: 0.01% or less, respectively. In addition, there is no decrease in the effects according to aspects of the present invention, even if Ta, Mg, and Zr are added within the ranges which are common among normal steel chemical compositions.

Hereafter, the microstructure of the high-strength steel sheet according to aspects of the present invention will be described.

The microstructure includes, in terms of volume fraction, 15% or less (including 0%) of ferrite having an average crystal grain diameter of 2 μm or less, 2% to 15% of retained austenite having an average crystal grain diameter of 2 μm or less, 10% or less (including 0%) of martensite having an average crystal grain diameter of 3 μm or less, and the balance being bainite and tempered martensite having an average crystal grain diameter of 6 μm or less. The term "volume fraction" here denotes the volume fraction with respect to the whole steel sheet, and the same shall apply hereafter.

In the case where the volume fraction of ferrite is more than 15%, since there is an increase in the number of voids generated when hole expansion is performed, and since it is necessary to increase the hardness of martensite and tempered martensite in order to achieve the desired strength, it is difficult to simultaneously achieve satisfactory strength and hole expansion formability. Moreover, from the viewpoint of bending workability, since the homogeneity of hardness decreases with an increase in the volume fraction of ferrite, the volume fraction of ferrite is set to be 15% or less, preferably 12% or less, or more preferably less than 10%. Here, the volume fraction of ferrite may be 0%. In addition, in the case where the average crystal grain diameter of ferrite is more than 2 μm, since voids, which are formed in a punched end surface, tend to combine with each other when hole expansion is performed, it is not possible to achieve good hole expansion formability. Therefore, the average crystal grain diameter of ferrite is set to be 2 μm or less.

In order to achieve good ductility, it is necessary that the volume fraction of retained austenite be in the range of 2% to 15%. Since there is a decrease in elongation in the case where the volume fraction of retained austenite is less than 2%, the lower limit of the volume fraction is set to be 2%, or preferably 4% or more. In addition, in the case where the volume fraction of retained austenite is more than 15%, since there is an excessive increase in the amount of martensite, which is formed through transformation of retained austenite after press forming has been performed, there is an increase in crack growth rate when hydrogen enters a steel sheet. Therefore, the upper limit of the volume fraction is set to be 15%, preferably 12% or less, or more preferably 11% or less. In addition, regarding the average crystal grain diameter of the retained austenite, the upper limit of the average crystal grain diameter is set to be 2 μm, since there is a decrease in delayed fracture resistance as martensite tends to be formed when press forming is performed due to the effect of the C distribution in the retained austenite. Although there is no particular limitation on the lower limit of the average crystal grain diameter, since the influence on elongation is large in the case where the average crystal grain diameter is less than 0.3 μm, it is preferable that the lower limit be 0.3 μm or more.

In order to achieve satisfactory delayed fracture resistance and hole expansion formability while achieving the desired strength, the volume fraction of martensite is set to be 10% or less, preferably 8% or less, or more preferably 5% or less. Here, the volume fraction of martensite may be 0%. In addition, in the case where the average crystal grain diameter of martensite is more than 3 μm, since voids, which are generated at the interface with ferrite, tend to combine with each other, there is a decrease in hole expansion formability. Therefore, the upper limit of the average crystal grain diameter of martensite is set to be 3 μm or less. Here, the term "martensite" denotes martensite which is formed when austenite, which remains untransformed, even after holding in a second soaking temperature range in continuous annealing, that is, a temperature range of 320° C. to 470° C., has been performed, is cooled to room temperature.

In order to achieve good hole expansion formability, it is necessary that the remainder which is other than ferrite, retained austenite, and martensite described above be bainite and tempered martensite. The average crystal grain diameter of bainite and tempered martensite is set to be 6 om or less. In the case where the average crystal grain diameter is more than 6 μm, since voids, which are formed at the interface with ferrite, tend to combine with each other, there is a decrease in hole expansion formability. Therefore, the upper limit of the average crystal grain diameter is set to be 6 μm or less. In addition, it is preferable that the volume fraction of bainite be 20% to 50% and that the volume fraction of tempered martensite be 35% to 85%. Here, the term "the volume fraction of bainite" denotes the volume proportion of bainitic ferrite (ferrite having a high dislocation density) in an observed plane, and the term "tempered martensite" denotes martensite which is formed by tempering martensite, which is formed through the transformation of part of untransformed austenite occurring during cooling in annealing to a temperature of 70° C. to 250° C., when the martensite is subjected to holding following heating to a temperature range of 320° C. to 470° C.

In addition, although there may be a case where pearlite is formed in addition to ferrite, retained austenite, martensite, bainite, and tempered martensite, which relate to aspects of the present invention, it is possible to achieve the object according to aspects of the present invention as long as the conditions described above regarding the volume fractions of ferrite, retained austenite, and martensite, the average crystal grain diameters of ferrite, retained austenite, and martensite, and the condition of distribution of cementite grains are satisfied. However, it is preferable that the volume fraction of pearlite be 3% or less.

In addition, it is necessary that the average number of cementite grains having a grain diameter of 0.04 μm or more existing in the bainite and tempered martensite grains be 10 or more. This is effective for increasing hole expansion formability, because there is an increase in delayed fracture resistance due to cementite grains functioning as hydrogen trap sites while the hardness of bainite or tempered martensite is not largely increased. In the case where the grain diameter is less than 0.04 m or the average number is less than 10, there is a decrease in delayed fracture resistance and hole expansion formability.

Hereafter, the method for manufacturing the high-strength steel sheet according to aspects of the present invention will be described. In the description below, the term "temperature" denotes the surface temperature of a steel sheet, unless otherwise noted.

The manufacturing method according to aspects of the present invention includes performing hot rolling on a steel slab having the chemical composition described above with a finish rolling completing temperature of 850° C. to 950° C., performing primary cooling to a temperature of 650° C. or lower at a first average cooling rate of 80° C./s or more, performing secondary cooling to a temperature of 550° C. or lower at a second average cooling rate of 5° C./s or more, coiling the cooled steel sheet at a coiling temperature of 550° C. or lower, pickling the obtained hot-rolled steel sheet, performing a (first) heat treatment in which the pickled steel sheet is heated to a temperature range of 400° C. to 700° C., subsequently performing cold rolling, performing an annealing process (second heat treatment) including heating the cold-rolled steel sheet to a temperature range of 800° C. to 930° C. at an average heating rate of 3° C./s to 30° C./s, holding the heated steel sheet at a first soaking temperature in a temperature range of 800° C. to 930° C. for 30 seconds or more, cooling the held steel sheet from the first soaking temperature to a cooling stop temperature range of 70° C. to 250° C. at a third average cooling rate of 3° C./s or more, heating the cooled steel sheet to a temperature range of 320° C. to 470° C., holding the heated steel sheet at a second soaking temperature in a temperature range of 320° C. to 470° C. for 30 seconds or more, cooling the held steel sheet to room temperature, and pickling the cooled steel sheet.

In the hot rolling process, it is preferable that hot rolling be started at a temperature of 1150° C. to 1300° C. without reheating a cast steel slab or after the cast steel slab has been reheated to a temperature of 1150° C. to 1300° C. Although it is preferable that the steel slab to be used be manufactured by using a continuous casting method in order to prevent the macro segregation of constituent chemical elements, an ingot-making method or a thin-slab casting method may be used. In accordance with aspects of the present invention, in addition to a conventional method, in which, after having manufactured a steel slab, the slab is first cooled to room temperature and then reheated, an energy-saving process such as a hot direct rolling or a direct rolling, that is, a method in which a slab in the hot state is charged into a heating furnace without cooling the slab, a method in which a slab is rolled immediately after heat retention has been performed, or a method in which a slab in the cast state is immediately rolled, may be used without causing any problem.

[Hot Rolling Process]

Finish rolling completing temperature: 850° C. to 950° C.

Since it is necessary that hot rolling be finished in a temperature range in which an austenite single phase is formed in order to increase elongation and hole expansion formability after annealing has been performed through the homogenization of a microstructure and the reduction of material anisotropy in a steel sheet, the finish rolling completing temperature is set to be 850° C. or higher. On the other hand, in the case where the finish rolling completing temperature is higher than 950° C., since there is an increase in the grain diameter of a hot-rolled microstructure, there is a deterioration in properties after annealing has been performed. Therefore, the finish rolling completing temperature is set to be 850° C. to 950° C.

Performing primary cooling to a temperature of 650° C. or lower at a first average cooling rate of 80° C./s or more followed by secondary cooling to a temperature of 550° C. or lower at a second average cooling rate of 5° C./s or more After hot rolling has been performed, the steel sheet microstructure of the hot-rolled steel sheet is controlled by performing rapid cooling to a temperature range in which bainite transformation occurs without the occurrence of ferrite transformation. Such homogenization control of a hot-rolled microstructure is effective for decreasing the grain diameter of a final steel sheet microstructure, in particular, ferrite and martensite. For this purpose, the primary cooling is performed to a temperature of 650° C. or lower at a first average cooling rate of 80° C./s or more. In the case where the first cooling rate is less than 80° C./s, since ferrite transformation starts, the steel sheet microstructure of the hot-rolled steel sheet becomes inhomogeneous, which results in a decrease in hole expansion formability after annealing has been performed. In addition, in the case where the primary cooling is performed to a temperature of higher than 650° C., since an excessive amount of pearlite is formed, the steel sheet microstructure of the hot-rolled steel sheet becomes inhomogeneous, which results in a decrease in hole expansion formability after annealing has been performed. Therefore, the primary cooling after finish rolling is performed to a temperature of 650° C. or lower at a first average cooling rate of 80° C./s or more. Subsequently, the secondary cooling is performed to a temperature of 550° C. or lower at a second average cooling rate of 5° C./s or more. In the case where the secondary cooling is performed to a temperature of higher than 550° C. or at a second average cooling rate of less than 5° C./s, since an excessive amount of ferrite or pearlite is formed in the steel sheet microstructure of the hot-rolled steel sheet, there is a decrease in hole expansion formability after annealing has been performed.

Coiling temperature: 550° C. or lower

Since an excessive amount of ferrite or pearlite is formed in the case where the coiling temperature is higher than 550° C., the upper limit of the coiling temperature is set to be 550° C. or lower, or preferably 500° C. or lower. Although there is no particular limitation on the lower limit of the coiling temperature, in the case where the coiling temperature is excessively low, since an excessive amount of hard martensite is formed, there is an increase in cold rolling load. Therefore, it is preferable that the coiling temperature be 300° C. or higher.

[Pickling Process]

It is preferable that a pickling process be performed after a hot rolling process in order to remove scale generated on the surface of the hot-rolled steel sheet. There is no particular limitation on the pickling process, and pickling may be performed by using a commonly used method.

[(First) Heat Treatment]

In accordance with aspects of the present invention, a heat treatment is performed twice after hot rolling has been performed. With this, as a result of decreasing the crystal grain diameter, and as a result of controlling the distribution and existing conditions of precipitated cementite, there is an increase in hole expansion formability and bending workability after the second heat treatment has been performed (after an annealing process). The first heat treatment is performed after hot rolling has been performed as described above in order to further homogenize the distribution of chemical elements such as C and Mn in the homogeneous bainite structure obtained in the hot-rolled microstructure. The first heat treatment is important for eliminating the segregation of chemical elements such as C and Mn so as to form the desired microstructure after the subsequent annealing process.

Heating to a temperature range of 400° C. to 700° C.

In the case where the heat treatment temperature of the first heat treatment is lower than 400° C., since it is not possible to eliminate the influence of the chemical element distribution after hot rolling has been performed due to insufficient chemical element redistribution, there is an increase in the hardenability of a region in which the initial C concentration is high due to the inhomogeneous distribution of C and Mn, even after the second heat treatment has been performed, and it is not possible to form the desired steel sheet microstructure. Moreover, since there is a decrease in the amount of cementite having a grain diameter of 0.04 μm or more, it is not possible to achieve sufficient delayed fracture resistance or hole expansion formability. On the other hand, in the case where heating is performed to a temperature higher than 700° C., since an excessive amount of hard martensite having a large grain diameter is formed, inhomogeneous microstructure is formed after the second heat treatment has been performed, and there is an excessive increase in strength due to an increase in the volume fraction of martensite, resulting in a significant decrease in elongation, hole expansion formability, and bending workability. Therefore, in order to form extremely homogeneous microstructure before cold rolling is performed, the heat treatment temperature of the first heat treatment, which is performed on the hot-rolled steel sheet, is set to be in the range of 400° C. to 700° C. It is preferable that the lower limit of the temperature be 450° C. or higher. It is preferable that the upper limit of the temperature be 650° C. or lower.

[Cold Rolling Process]

A cold rolling process is performed in order to obtain a cold-rolled steel sheet having a predetermined thickness. There is no particular limitation on the cold rolling process, and cold rolling may be performed by using a commonly used method.

[Annealing Process] (Second Heat Treatment)

The annealing process, that is, the second heat treatment is performed in order to promote recrystallization and to form bainite, tempered martensite, retained austenite, and martensite in a steel sheet microstructure for the purpose of increasing strength. For this purpose, the annealing process includes heating the cold-rolled steel sheet to a temperature range of 800° C. to 930° C. at an average heating rate of 3° C./s to 30° C./s, holding the heated steel sheet at a first soaking temperature in a temperature range of 800° C. to 930° C. for 30 seconds or more, cooling the held steel sheet from the first soaking temperature to a cooling stop temperature range of 70° C. to 250° C. at a third average cooling rate of 3° C./s or more, heating the cooled steel sheet to a temperature range of 320° C. to 470° C., holding the heated steel sheet at a second soaking temperature in a temperature range of 320° C. to 470° C. for 30 seconds or more, and cooling the held steel sheet to room temperature.

Average heating rate: 3° C./s to 30° C./s

It is possible to decrease the crystal grain diameter after annealing has been performed. Since recrystallization is less likely to progress in the case of rapid heating, the upper limit of the average heating rate is set to be 30° C./s. In addition, in the case where the average heating rate is excessively small, since there is an increase in the grain diameter of ferrite and martensite, it is not possible to achieve the predetermined average crystal grain diameter. Therefore, it is necessary that the average heating rate be 3° C./s or more, or preferably 5° C./s or more.

First soaking temperature: 800° C. to 930° C.

The first soaking temperature is set to be in a temperature range in which a dual phase composed of ferrite and austenite or an austenite single phase is formed. In the case where the soaking temperature is lower than 800° C., since there is an increase in ferrite phase fraction, it is difficult to simultaneously achieve satisfactory strength, hole expansion formability, and bending workability. Therefore, the lower limit of the soaking temperature is set to be 800° C. In the case where the soaking temperature is excessively high, since the crystal grain growth of austenite becomes marked, there is a decrease in delayed fracture resistance due to an excessive increase in crystal grain diameter. Therefore, the upper limit of the soaking temperature is set to be 930° C., or preferably 880° C. or lower.

Hold time: 30 seconds or more

In order to promote recrystallization and to allow all or part of austenite to transform at the first soaking temperature described above, it is necessary that the hold time be 30 seconds or more. Although there is no particular limitation on the upper limit of the hold time, it is preferable that the hold time be 600 seconds or less.

Cooling to a cooling stop temperature range of 70° C. to 250° C. at a third average cooling rate of 3° C./s or more For the purpose of forming tempered martensite from the viewpoint of hole expansion formability, cooling is performed from the soaking temperature to a temperature equal to or lower than the martensite transformation start temperature in order to allow part of austenite, which has been formed in the soaking zone, to transform into martensite. That is, cooling is performed to a cooling stop temperature range of 70° C. to 250° C. at a third average cooling rate of 3° C./s or more. Since excessive amounts of pearlite and spherical cementite are formed in a steel sheet microstructure in the case where the cooling rate is less than 3° C./s, the lower limit of the cooling rate is set to be 3° C./s. In addition, in the case where the cooling stop temperature is lower than 70° C., since there is a decrease in the amount of untransformed austenite due to an excessive amount of martensite being formed when cooling is performed, there is a decrease in the amount of bainite transformation and in the amount of retained austenite, which results in a decrease in elongation. In the case where the cooling stop temperature is higher than 250° C., since there is a decrease in the amount of tempered martensite, there is a decrease in hole expansion formability. Therefore, the cooling stop temperature is set to be 70° C. to 250° C. It is preferable that the lower limit of the cooling stop temperature be 150° C. or higher. It is preferable that the upper limit of the cooling stop temperature be 220° C. or lower.

Holding at a second soaking temperature in a temperature range of 320° C. to 470° C. for 30 seconds or more In order to form tempered martensite by tempering martensite, which is formed in the middle of cooling, in order to form bainite and retained austenite in a steel sheet microstructure by allowing untransformed austenite to transform into bainite, and in order to allow cementite grains to be precipitated and grown, reheating is performed after cooling from the first soaking temperature has been performed, and the reheated steel sheet is held in a temperature range of 320° C. to 470° C. for 30 seconds or more. In the case where the second soaking temperature is lower than 320° C., since martensite is not sufficiently tempered, there is an increase in the difference in hardness between ferrite and martensite, which results in a decrease in hole expansion formability. Moreover, since an increase in the grain diameter of cementite is inhibited, there is a decrease in delayed fracture resistance. In addition, in the case where the second soaking temperature is higher than 470° C., since an excessive amount of pearlite is formed, there is a decrease in elongation. Therefore, the second soaking temperature is set to be 320° C. to 470° C. In addition, in the case where the hold time is less than 30 seconds, since bainite transformation does not sufficiently progress, an excessive amount of martensite is finally formed due to a large amount of untransformed austenite being remained, which results in a decrease in hole expansion formability.

Here, pickling is performed by using a commonly used method after cooling has been performed to room temperature.

In addition, skin pass rolling may be performed after the annealing process. It is preferable that the elongation ratio of skin pass rolling be in a range of 0.05% to 2.0%.

Here, within the range according to aspects of the present invention, a galvanized steel sheet may be manufactured by performing a galvanizing treatment in the annealing process, and a galvannealed steel sheet may be manufactured by performing an alloying treatment after a galvanizing treatment has been performed. Moreover, by performing an electroplating treatment on the steel sheet according to aspects of the present invention, an electroplated steel sheet may be manufactured.

EXAMPLES

Hereafter, the examples of the present invention will be described. However, the present invention is not limited by the examples described below, and the present invention may be performed by appropriately making alterations within a range in accordance with the spirit of the present invention. Working examples performed in such a way are all within the technical scope of aspects of the present invention.

By preparing molten steels having the chemical compositions given in Table 1, by casting the molten steels into slabs, by performing hot rolling on the slabs with a heating temperature of 1250° C. and a finish rolling completing temperatures (FDT) under the conditions given in Table 2, hot-rolled steel sheets having a thickness of 3.2 mm were obtained. The hot-rolled steel sheets were cooled to the first cooling temperatures at the first average cooling rates (CR1) given in Table 2, then cooled to the second cooling temperatures at the second average cooling rates (CR2), and then coiled at the coiling temperatures (CT) given in Table 2. Subsequently, the obtained hot-rolled steel sheets were subjected to pickling followed by the initial heat treatment (first heat treatment) under the conditions given in Table 2. Subsequently, by performing cold rolling on the treated sheet sheets, cold-rolled steel sheets (having a thickness of 1.4 mm) were obtained. Subsequently, the obtained cold-rolled steel sheets were heated at the average heating rates given in Table 2, then annealed at the first soaking temperatures for the hold time (first hold time) given in Table 2, then cooled to the cooling stop temperatures (Ta) at the third average cooling rates (CR3) given in Table 2, then heated and held (for the second hold time) at the second soaking temperatures (Tb) given in Table 2, and then pickled after having been cooled to room temperature.

TABLE 1

| Steel | Chemical Composition (mass %) | | | | | | | | | |
|---|---|---|---|---|---|---|---|---|---|---|
| Grade | C | Si | Mn | P | S | Al | N | B | Other | Note |
| A | 0.18 | 1.45 | 2.58 | 0.01 | 0.001 | 0.03 | 0.002 | 0.0025 | Ti: 0.02 | Example Steel |
| B | 0.19 | 1.39 | 2.68 | 0.01 | 0.001 | 0.02 | 0.003 | 0.0012 | Cu: 0.18 | Example Steel |
| C | 0.18 | 1.64 | 2.74 | 0.01 | 0.002 | 0.01 | 0.002 | 0.0017 | Sn: 0.17 | Example Steel |
| D | 0.16 | 1.41 | 3.02 | 0.01 | 0.001 | 0.03 | 0.003 | 0.0029 | Ni: 0.38 | Example Steel |
| E | 0.18 | 1.88 | 2.34 | 0.01 | 0.001 | 0.02 | 0.002 | 0.0020 | Ti: 0.01, Co: 0.04 | Example Steel |
| F | 0.21 | 1.49 | 2.25 | 0.02 | 0.002 | 0.03 | 0.003 | 0.0018 | Mo: 0.24 | Example Steel |
| G | 0.22 | 1.32 | 2.44 | 0.01 | 0.001 | 0.03 | 0.001 | 0.0022 | Sn: 0.17, V: 0.02 | Example Steel |
| H | 0.16 | 1.02 | 2.25 | 0.02 | 0.002 | 0.03 | 0.002 | 0.0018 | Cu: 0.18, Nb: 0.05 | Example Steel |
| I | 0.16 | 1.22 | 2.43 | 0.01 | 0.002 | 0.03 | 0.001 | 0.0029 | Ni: 0.22, Cr: 0.25 | Example Steel |
| J | 0.19 | 1.44 | 2.74 | 0.02 | 0.002 | 0.04 | 0.003 | 0.0019 | Sn: 0.19, Ca: 0.0022 | Example Steel |
| K | 0.17 | 1.49 | 2.64 | 0.01 | 0.001 | 0.03 | 0.002 | 0.0033 | Co: 0.03, REM: 0.0021 | Example Steel |
| L | 0.21 | 1.74 | 2.55 | 0.01 | 0.002 | 0.03 | 0.003 | 0.0010 | — | Comparative Example |
| M | 0.12 | 1.66 | 2.94 | 0.01 | 0.002 | 0.03 | 0.002 | 0.0015 | Ti: 0.01, Sn: 0.18 | Comparative Example |
| N | 0.21 | 0.44 | 2.89 | 0.01 | 0.002 | 0.03 | 0.003 | 0.0022 | Mo: 0.21 | Comparative Example |
| O | 0.18 | 1.88 | 1.87 | 0.01 | 0.002 | 0.03 | 0.003 | 0.0031 | Co: 0.04 | Comparative Example |
| P | 0.18 | 1.05 | 3.68 | 0.01 | 0.002 | 0.03 | 0.003 | 0.0019 | Cu: 0.22 | Comparative Example |

Underlined portion: out of the range of the present invention

TABLE 2

| | | Hot Rolling and Cold Rolling | | | | | | First Heat | Second Heat Treatment | | | | | | |
|---|---|---|---|---|---|---|---|---|---|---|---|---|---|---|---|
| Sample Number | Steel Grade | FDT (° C.) | CR1 (° C./s) | First Cooling Temperature (° C.) | CR2 (° C./s) | Second Cooling Temperature (° C.) | CT (° C.) | Treatment Annealing Temperature (° C.) | Average Heating Rate (° C./s) | First Soaking Temperature (° C.) | First Hold Time (sec) | CR3 (° C./s) | Ta (° C.) | Tb (° C.) | Second Hold Time (sec) |
| 1 | A | 900 | 110 | 610 | 25 | 480 | 480 | 600 | 10 | 810 | 300 | 5 | 150 | 400 | 600 |
| 2 | B | 900 | 100 | 570 | 25 | 450 | 450 | 550 | 12 | 850 | 300 | 6 | 200 | 420 | 600 |
| 3 | C | 900 | 100 | 580 | 20 | 500 | 500 | 500 | 15 | 820 | 300 | 6 | 180 | 370 | 600 |
| 4 | D | 900 | 100 | 600 | 20 | 450 | 450 | 500 | 10 | 800 | 600 | 10 | 180 | 350 | 1000 |
| 5 | E | 900 | 100 | 600 | 20 | 450 | 450 | 500 | 12 | 900 | 600 | 10 | 150 | 420 | 300 |
| 6 | F | 900 | 110 | 640 | 25 | 520 | 520 | 450 | 10 | 850 | 60 | 8 | 100 | 400 | 300 |
| 7 | G | 900 | 100 | 600 | 20 | 480 | 480 | 600 | 10 | 810 | 600 | 5 | 180 | 380 | 500 |
| 8 | H | 900 | 150 | 580 | 20 | 470 | 470 | 500 | 12 | 830 | 120 | 10 | 220 | 400 | 600 |
| 9 | I | 900 | 100 | 570 | 25 | 450 | 450 | 550 | 10 | 840 | 600 | 10 | 200 | 400 | 600 |
| 10 | J | 900 | 100 | 540 | 20 | 450 | 450 | 550 | 10 | 850 | 600 | 8 | 150 | 400 | 300 |
| 11 | K | 900 | 100 | 550 | 25 | 450 | 450 | 600 | 10 | 850 | 100 | 8 | 150 | 400 | 300 |
| 12 | A | 900 | 40 | 550 | 20 | 480 | 480 | 600 | 10 | 850 | 600 | 5 | 180 | 400 | 600 |
| 13 | A | 900 | 100 | 750 | 20 | 470 | 470 | 600 | 8 | 850 | 600 | 8 | 180 | 400 | 600 |
| 14 | A | 900 | 100 | 550 | 2 | 470 | 470 | 600 | 10 | 850 | 300 | 8 | 180 | 400 | 300 |
| 15 | A | 900 | 100 | 600 | 20 | 700 | 700 | 600 | 7 | 820 | 600 | 8 | 150 | 400 | 300 |
| 16 | A | 900 | 100 | 600 | 25 | 470 | 470 | — | 10 | 850 | 600 | 8 | 150 | 400 | 600 |
| 17 | B | 900 | 100 | 600 | 30 | 470 | 470 | 850 | 10 | 850 | 600 | 8 | 150 | 380 | 600 |
| 18 | B | 900 | 100 | 600 | 25 | 470 | 470 | 600 | 1 | 830 | 600 | 8 | 180 | 400 | 300 |
| 19 | B | 900 | 100 | 600 | 25 | 470 | 470 | 600 | 50 | 830 | 300 | 6 | 180 | 420 | 300 |
| 20 | B | 920 | 100 | 580 | 25 | 470 | 470 | 600 | 10 | 750 | 600 | 8 | 150 | 400 | 300 |
| 21 | B | 900 | 100 | 600 | 25 | 470 | 470 | 600 | 10 | 950 | 600 | 10 | 180 | 400 | 600 |
| 22 | B | 880 | 100 | 600 | 25 | 470 | 470 | 550 | 10 | 850 | 300 | 1 | 200 | 400 | 600 |
| 23 | B | 900 | 100 | 600 | 25 | 480 | 480 | 600 | 10 | 850 | 300 | 7 | 50 | 400 | 600 |
| 24 | C | 900 | 100 | 550 | 25 | 470 | 470 | 600 | 8 | 850 | 600 | 5 | 350 | 400 | 600 |
| 25 | C | 900 | 100 | 600 | 25 | 500 | 500 | 600 | 10 | 850 | 600 | 5 | 200 | 550 | 600 |
| 26 | C | 900 | 100 | 600 | 25 | 470 | 470 | 600 | 8 | 850 | 600 | 5 | 200 | 250 | 500 |
| 27 | C | 900 | 100 | 580 | 25 | 470 | 470 | 600 | 10 | 850 | 600 | 8 | 220 | 400 | 10 |
| 28 | L | 900 | 100 | 600 | 25 | 470 | 470 | 600 | 10 | 850 | 600 | 8 | 180 | 380 | 600 |

TABLE 2-continued

| Sample Number | Steel Grade | Hot Rolling and Cold Rolling: FDT (° C.) | CR1 (° C./s) | First Cooling Temperature (° C.) | CR2 (° C./s) | Second Cooling Temperature (° C.) | CT (° C.) | First Heat Treatment Annealing Temperature (° C.) | Second Heat Treatment: Average Heating Rate (° C./s) | First Soaking Temperature (° C.) | First Hold Time (sec) | CR3 (° C./s) | Ta (° C.) | Tb (° C.) | Second Hold Time (sec) |
|---|---|---|---|---|---|---|---|---|---|---|---|---|---|---|---|
| 29 | M | 900 | 100 | 600 | 25 | 470 | 470 | 600 | 10 | 830 | 600 | 8 | 180 | 400 | 600 |
| 30 | N | 900 | 100 | 600 | 25 | 470 | 470 | 580 | 10 | 850 | 600 | 8 | 180 | 380 | 600 |
| 31 | O | 900 | 100 | 600 | 25 | 470 | 470 | 600 | 8 | 830 | 600 | 8 | 180 | 400 | 600 |
| 32 | P | 900 | 100 | 600 | 25 | 470 | 470 | 600 | 10 | 850 | 600 | 8 | 180 | 400 | 600 |

Underlined portion: out of the range of the present invention

By performing a tensile test (JIS Z 2241 (1998)) on a JIS No. 5 tensile test piece which had been taken from the obtained steel sheet so that the longitudinal direction (tensile direction) of the test piece was a direction perpendicular to the rolling direction, tensile strength (TS) and total elongation (EL) were determined. A steel sheet having a tensile strength of 1180 MPa or more and a total elongation of 17.0% or more was judged as an excellent steel sheet.

Regarding hole expansion formability, in accordance with The Japan Iron and Steel Federation Standard (JFS T 1001 (1996)), by punching a hole having a diameter of 10 mmϕ in a sample with a clearance of 12.5%, by setting the sample on a testing machine so that the burr was on the die side, and by forming the sample with a conical punch having a point angle of 60°, hole expansion ratio (λ) was determined. A steel sheet having a λ (%) of 45% or more was judged as a steel sheet having good hole expansion formability.

Regarding bending workability, by performing a 90-degree V-bend test (with a bending ridge line running in the rolling direction) through the use of a V-block method in accordance with JIS Z 2248 (1996) on a bending test piece of 30 mm×100 mm which had been taken from each of the annealed steel sheets so that the longitudinal direction of the test piece was perpendicular to the rolling direction, bendability was investigated. Regarding the judgement of cracking, by observing the outer surface and cross section of the bent portion by using an optical microscope and a SEM, the result was represented by the ratio (R/t) of the minimum bending radius R with which cracking did not occur to the thickness t (=1.4 mm). A steel sheet having an R/t of 2.0 or less was judged as a steel sheet excellent in terms of bending workability.

Regarding delayed fracture resistance, by taking a test piece of 30 mm×100 mm from the obtained cold-rolled steel sheet so that the longitudinal direction of the test piece was the rolling direction, by grinding the end surfaces of the test piece, and by using a punch having a tip curvature radius of 10 mm, bending work at an angle of 1800 was performed on the test piece. By bolting the test piece which had been subjected to bending work against spring back which occurred in the test piece so that the inner distance was 20 mm in order to apply stress to the test piece, and by then immersing the test piece in hydrochloric acid having a temperature of 25° C. and a pH of 1.5, time until fracturing occurred was determined within 100 hours. A case where a crack did not occur in the test piece within 100 hours was judged as "○" (good), and a case where a crack occurred in the test piece was judged as "x" (poor). Here, the crack of the test piece was visually identified.

The volume fractions of ferrite and martensite of the steel sheet were determined by polishing a cross section in the thickness direction parallel to the rolling direction of the steel sheet, by then etching the polished cross section through the use of a 3 vol % nital solution, by observing the etched cross section through the use of a SEM (scanning electron microscope) at a magnification of 2000 times and 5000 times, by determining the area fraction of each of the phases through the use of a point-counting method (in accordance with ASTM E562-83 (1988)), and by defining the area fraction as the volume fraction. Regarding the average crystal grain diameters of ferrite and martensite, since it was possible to calculate the areas of the grains of each of the phases by inputting the steel sheet microstructure photographs, in which the crystal grains of ferrite and martensite had been identified in advance, into Image-Pro produced by Media Cybernetics, Inc., by calculating circle-equivalent diameters from the calculated areas, the average crystal grain diameter of each of the phases was defined as the average of the calculated circle-equivalent diameters.

The volume fraction of retained austenite was determined by polishing the steel sheet in order to expose a surface located at ¼ of the thickness of the steel sheet and by determining the X-ray diffraction intensities of the exposed surface. By determining the integrated X-ray diffraction intensities of the {200}-plane, {211}-plane, and {220}-plane of the ferrite of iron and the {200}-plane, {220}-plane, and {311}-plane of the austenite of iron through the use of the Kα ray of Mo as a radiation source with an acceleration voltage of 50 keV in X-ray diffractometry (apparatus: RINT-2200 produced by Rigaku Corporation), and by using the calculating formula described in "X-ray Diffraction Handbook" published by Rigaku Corporation (2000), pp. 26 and 62-64, the volume fraction of retained austenite was determined. The average crystal grain diameter of retained austenite was determined by performing observation at a magnification of 5000 times through the use of EBSD (Electron Back Scatter Diffraction) method, by calculating circle-equivalent diameters through the use of Image-Pro, and by calculating the average of the circle-equivalent diameters.

In addition, by observing a steel sheet microstructure through the use of a SEM (scanning electron microscope), a TEM (transmission electron microscope), and an FE-SEM (field-emission scanning electron microscope), the kinds of steel microstructures other than ferrite, retained austenite, and martensite were identified. The average crystal grain diameter of bainite and tempered martensite was determined by calculating circle-equivalent diameters from a steel sheet microstructure photograph through the use of Image-Pro described above and by calculating the average of the circle-equivalent diameters.

The grain diameter of cementite was determined by performing observation at a magnification of 5000 times, 10000 times, and 20000 times through the use of a SEM (scanning electron microscope) and TEM (transmission electron microscope) and by calculating circle-equivalent diameters through the use of Image-Pro. The number of cementite grains having a grain diameter of 0.04 μm or more existing in bainite and tempered martensite grains was determined by performing observation at a magnification of 5000 times, 10000 times, and 20000 times through the use of a SEM (scanning electron microscope) and a TEM (transmission electron microscope) and by calculating the average number of randomly selected 10 positions.

The determined tensile strength, total elongation, hole expansion formability, bending workability, delayed fracture resistance, and steel sheet microstructure are given in Table 3.

TABLE 3

| | Steel Sheet Microstructure | | | | | | | |
|---|---|---|---|---|---|---|---|---|
| | Ferrite | | Retained Austenite | | Martensite | | Remainder | |
| Sample Number | Volume Fraction (%) | Average Grain Diameter (μm) | Volume Fraction (%) | Average Grain Diameter (μm) | Volume Fraction (%) | Average Grain Diameter (μm) | Kind | Average Grain Diameter (μm) |
| 1 | 8 | 2 | 9 | 1 | 4 | 1 | B, TM | 3 |
| 2 | 2 | 1 | 11 | 1 | 3 | 2 | B, TM | 2 |
| 3 | 12 | 2 | 10 | 2 | 4 | 2 | B, TM | 3 |
| 4 | 13 | 2 | 10 | 2 | 5 | 2 | B, TM | 3 |
| 5 | 0 | — | 7 | 1 | 4 | 3 | B, TM | 5 |
| 6 | 1 | 1 | 7 | 1 | 4 | 2 | B, TM | 3 |
| 7 | 10 | 2 | 10 | 2 | 3 | 3 | B, TM | 3 |
| 8 | 7 | 2 | 9 | 1 | 5 | 2 | B, TM | 2 |
| 9 | 4 | 1 | 8 | 1 | 3 | 2 | B, TM | 2 |
| 10 | 2 | 1 | 7 | 1 | 4 | 3 | B, TM | 3 |
| 11 | 2 | 1 | 8 | 1 | 0 | — | B, TM | 4 |
| 12 | 1 | 1 | 8 | 1 | 3 | 4 | B, TM | 3 |
| 13 | 0 | — | 8 | 2 | 3 | 4 | B, TM | 5 |
| 14 | 0 | — | 8 | 1 | 4 | 4 | B, TM | 5 |
| 15 | 8 | 3 | 7 | 3 | 3 | 1 | B, TM | 7 |
| 16 | 0 | — | 8 | 1 | 4 | 4 | B, TM | 4 |
| 17 | 2 | 2 | 9 | 2 | 6 | 4 | B, TM | 3 |
| 18 | 1 | 1 | 6 | 1 | 4 | 4 | B, TM | 4 |
| 19 | 1 | 1 | 6 | 1 | 3 | 5 | B, TM | 4 |
| 20 | 19 | 4 | 8 | 1 | 3 | 4 | B, TM | 5 |
| 21 | 0 | — | 6 | 1 | 4 | 5 | B, TM | 8 |
| 22 | 16 | 3 | 8 | 3 | 4 | 4 | B, TM, P | 4 |
| 23 | 3 | 2 | 9 | 1 | 5 | 3 | B, TM | 7 |
| 24 | 2 | 1 | 4 | 2 | 8 | 2 | B, TM | 5 |
| 25 | 0 | — | 1 | 1 | 4 | 2 | B, TM, P | 4 |
| 26 | 2 | 1 | 4 | 1 | 4 | 1 | B, TM | 3 |
| 27 | 2 | 1 | 1 | 2 | 18 | 5 | B | 4 |
| 28 | 3 | 3 | 5 | 2 | 5 | 4 | B, TM, P | 4 |
| 29 | 17 | 2 | 4 | 2 | 3 | 2 | B, TM | 3 |
| 30 | 0 | — | 1 | 1 | 4 | 3 | B, TM | 4 |
| 31 | 16 | 3 | 2 | 1 | 3 | 3 | B, TM, P | 4 |
| 32 | 0 | — | 6 | 3 | 11 | 5 | B, TM | 6 |

| Sample Number | Average Number of Cementite Grain Having Diameter of 0.04 μm or More | Tensile Property TS (MPa) | Tensile Property EL (%) | Hole Expansion Formability λ (%) | Bending Workability R/t | Delayed Fracture Resistance | Note |
|---|---|---|---|---|---|---|---|
| 1 | 13 | 1221 | 19.0 | 50 | 1.4 | ○ | Example |
| 2 | 14 | 1218 | 19.3 | 48 | 1.8 | ○ | Example |
| 3 | 13 | 1219 | 18.9 | 49 | 1.8 | ○ | Example |
| 4 | 12 | 1189 | 19.3 | 50 | 1.8 | ○ | Example |
| 5 | 15 | 1183 | 18.3 | 46 | 1.4 | ○ | Example |
| 6 | 12 | 1184 | 18.4 | 46 | 1.8 | ○ | Example |
| 7 | 12 | 1211 | 18.5 | 50 | 1.8 | ○ | Example |
| 8 | 14 | 1184 | 19.0 | 48 | 1.8 | ○ | Example |
| 9 | 12 | 1181 | 19.1 | 55 | 1.8 | ○ | Example |
| 10 | 12 | 1182 | 18.1 | 50 | 1.8 | ○ | Example |
| 11 | 14 | 1205 | 18.0 | 50 | 1.8 | ○ | Example |
| 12 | 13 | 1190 | 17.2 | 40 | 2.1 | ○ | Comparative Example |
| 13 | 14 | 1215 | 17.7 | 31 | 1.8 | ○ | Comparative Example |
| 14 | 13 | 1212 | 17.6 | 35 | 1.8 | ○ | Comparative Example |
| 15 | 12 | 1188 | 17.9 | 33 | 1.8 | X | Comparative Example |
| 16 | 9 | 1222 | 17.6 | 22 | 2.9 | X | Comparative Example |
| 17 | 12 | 1211 | 15.9 | 28 | 2.5 | X | Comparative Example |
| 18 | 10 | 1194 | 16.8 | 21 | 1.8 | ○ | Comparative Example |
| 19 | 11 | 1234 | 14.3 | 17 | 2.1 | ○ | Comparative Example |
| 20 | 16 | 1122 | 18.2 | 12 | 1.8 | ○ | Comparative Example |
| 21 | 8 | 1198 | 16.3 | 50 | 1.8 | X | Comparative Example |

TABLE 3-continued

| | | | | | | | |
|---|---|---|---|---|---|---|---|
| 22 | 12 | 1138 | 19.1 | 18 | 2.1 | X | Comparative Example |
| 23 | 18 | 1221 | 13.9 | 40 | 1.8 | ○ | Comparative Example |
| 24 | 6 | 1296 | 14.9 | 13 | 2.1 | X | Comparative Example |
| 25 | 19 | 1211 | 15.5 | 27 | 1.8 | ○ | Comparative Example |
| 26 | 4 | 1195 | 17.3 | 22 | 1.8 | X | Comparative Example |
| 27 | 3 | 1288 | 15.4 | 5 | 3.2 | X | Comparative Example |
| 28 | 9 | 1189 | 16.9 | 40 | 1.8 | X | Comparative Example |
| 29 | 11 | 1127 | 18.1 | 21 | 2.1 | ○ | Comparative Example |
| 30 | 19 | 1215 | 15.5 | 42 | 2.1 | ○ | Comparative Example |
| 31 | 11 | 1167 | 17.0 | 21 | 1.8 | ○ | Comparative Example |
| 32 | 9 | 1203 | 16.8 | 18 | 2.5 | X | Comparative Example |

Underlined portion: out of the range of the present invention
Remainder: B—bainite, TM—tempered martensite, P—pearlite From the results given in Table 3, it is clarified that, in the case of any one of the examples of the present invention, a microstructure including, in terms of volume fraction, 15% or less (including 0%) of ferrite having an average crystal grain diameter of 2 μm or less, 2% to 15% of retained austenite having an average crystal grain diameter of 2 μm or less, 10% or less (including 0%) of martensite having an average crystal grain diameter of 3 μm or less, and the balance being bainite and tempered martensite having an average crystal grain diameter of 6 μm or less was formed and, as a result, a tensile strength of 1180 MPa or more and good workability represented by a total elongation of 17.0% or more, a hole expansion ratio of 45% or more, and an R/t of 2.0 or less were achieved, and excellent delayed fracture resistance was achieved as indicated by the fact that fracturing did not occurred within 100 hours in the test for evaluating delayed fracture resistance. On the other hand, in the case of the comparative examples, the steel sheet microstructures were out of the range of the present invention and, as a result, the evaluation results were poor in terms of at least one of tensile strength, total elongation, hole expansion formability, bending workability, and delayed fracture resistance.

The invention claimed is:

1. A high-strength steel sheet having
a chemical composition containing, by mass %,
C: 0.15% to 0.25%,
Si: 1.00% to 2.20%,
Mn: 2.00% to 3.50%,
P: 0.05% or less,
S: 0.005% or less,
Al: 0.01% to 0.50%,
N: 0.010% or less,
B: 0.0003% to 0.0050%,
one, two, or more selected from
Ti: 0.005% to 0.05%,
Cu: 0.003% to 0.50%,
Ni: 0.003% to 0.50%,
Sn: 0.003% to 0.50%,
Co: 0.003% to 0.05%, and
Mo: 0.003% to 0.50%, and the balance being Fe and inevitable impurities, and
a microstructure including, in terms of volume fraction, 15% or less (including ○%) of ferrite having an average crystal grain diameter of 2 m or less, 2% to 15% of retained austenite having an average crystal grain diameter of 2 m or less, 10% or less (including 0%) of martensite having an average crystal grain diameter of 3 m or less, and the balance being bainite and tempered martensite having an average crystal grain diameter of 6 m or less,
wherein the average number of cementite grains having a grain diameter of 0.04 m or more existing in the bainite and tempered martensite grains is 10 or more,
wherein the high-strength steel sheet has a tensile strength of 1180 MPa or more, and
wherein the high-strength steel sheet has a hole expansion formability A of 45% or more, as measured according to JFS T1001 (1996) and a bending workability of R/t of 2.0 or less, as measured according to JIS Z 2248 (1996).

2. The high-strength steel sheet according to claim 1, wherein the chemical composition further contains, by mass %, one, two, or more selected from
V: 0.05% or less,
Nb: 0.05% or less,
Cr: 0.50% or less, and
Ca and/or REM: 0.0050% or less in total.

3. A method for manufacturing the high-strength steel sheet of claim 1, the method comprising performing hot rolling on a steel slab having the chemical composition with a finish rolling completing temperature of 850° C. to 950° C., performing primary cooling to a temperature of 650° C. or lower at a first average cooling rate of 80° C./s or more, performing secondary cooling to a temperature of 550° C. or lower at a second average cooling rate of 5° C./s or more, coiling the cooled steel sheet at a coiling temperature of 550° C. or lower, pickling the obtained steel sheet, performing a heat treatment in which the pickled steel sheet is heated to a temperature range of 400° C. to 700° C., subsequently performing cold rolling, heating the cold-rolled steel sheet to a temperature range of 800° C. to 930° C. at an average heating rate of 3° C./s to 30° C./s, holding the steel sheet at a first soaking temperature in a temperature range of 800° C. to 930° C. for 30 seconds or more, cooling the held steel sheet from the first soaking temperature to a cooling stop temperature of 70° C. to 250° C. at a third average cooling rate of 3° C./s or more, heating the cooled steel sheet to a temperature of 320° C. to 470° C., holding the heated steel sheet at a second soaking temperature in a temperature range of 320° C. to 470° C. for 30 seconds or more, cooling the held steel sheet to room temperature, and pickling the cooled steel sheet.

4. A method for manufacturing the high-strength steel sheet of claim 2, the method comprising performing hot rolling on a steel slab having the chemical composition with a finish rolling completing temperature of 850° C. to 950° C., performing primary cooling to a temperature of 650° C. or lower at a first average cooling rate of 80° C./s or more, performing secondary cooling to a temperature of 550° C. or lower at a second average cooling rate of 5° C./s or more, coiling the cooled steel sheet at a coiling temperature of 550° C. or lower, pickling the obtained steel sheet, performing a heat treatment in which the pickled steel sheet is heated to a temperature range of 400° C. to 700° C., subsequently performing cold rolling, heating the cold-rolled steel sheet to a temperature range of 800° C. to 930° C. at an average heating rate of 3° C./s to 30° C./s, holding the steel sheet at a first soaking temperature in a temperature range of 800° C. to 930° C. for 30 seconds or more, cooling the held steel sheet from the first soaking temperature to a cooling stop temperature of 70° C. to 250° C. at a third average cooling rate of 3° C./s or more, heating the cooled steel sheet to a temperature of 320° C. to 470° C., holding the heated steel sheet at a second soaking temperature in a temperature range of 320° C. to 470° C. for 30 seconds or more, cooling the held steel sheet to room temperature, and pickling the cooled steel sheet.

* * * * *